US011878209B1

(12) United States Patent
Cassels

(10) Patent No.: US 11,878,209 B1
(45) Date of Patent: Jan. 23, 2024

(54) FOLDING EXERCISE MAT

(71) Applicant: Peter Cassels, Bonita Springs, FL (US)

(72) Inventor: Peter Cassels, Bonita Springs, FL (US)

( * ) Notice: Subject to any disclaimer, the term of this patent is extended or adjusted under 35 U.S.C. 154(b) by 84 days.

(21) Appl. No.: 16/661,222

(22) Filed: Oct. 23, 2019

(51) Int. Cl.
*A63B 21/00* (2006.01)

(52) U.S. Cl.
CPC ..... *A63B 21/4037* (2015.10); *A63B 2210/50* (2013.01)

(58) Field of Classification Search
CPC ..... A63B 21/4037; A63B 21/4027; A63B 69/3661; A63B 69/3691; A63B 67/02; A63B 71/0054; A63B 2209/00; A63B 2209/02; A63B 2209/023; A63B 2209/026; A63B 2209/08; A63B 2209/10; A63B 2209/14; A63B 2209/18; A63B 6/00; A63B 6/02; A63B 6/025; A63B 60/56; A63B 2210/50; A63F 2003/0094; A63F 2003/00233
USPC ..... 482/23
See application file for complete search history.

(56) References Cited

U.S. PATENT DOCUMENTS 1,641,104 A * 8/1927 Solod ..... A63F 3/0023 273/285
3,319,273 A * 5/1967 Solin ..... A63B 6/00 473/29
3,513,491 A * 5/1970 Gordon ..... A47C 27/00 5/420
3,526,911 A * 9/1970 Meyer ..... A63C 19/04 428/33
3,664,666 A * 5/1972 Lloyd ..... A63B 17/00 482/121
4,037,591 A * 7/1977 Sarno ..... A61H 7/001 5/699
4,097,944 A * 7/1978 Yulish ..... A47G 9/062 5/419
4,137,348 A * 1/1979 Gilman ..... B32B 3/18 427/386
4,478,413 A * 10/1984 Siwula ..... A63B 21/0455 482/123
4,574,101 A 3/1986 Tricca et al.
4,905,990 A * 3/1990 DeSantis ..... A63B 6/00 482/148
4,917,505 A * 4/1990 Bullard ..... A45C 9/00 383/4
5,066,001 A * 11/1991 Wilkinson ..... A63B 21/4037 482/52

(Continued)

FOREIGN PATENT DOCUMENTS

CN 104223816 * 9/2014

OTHER PUBLICATIONS

Seo S M, Multi-functional mattress for use in building, has wing portion fixed with side of material that is protruded to outer side of buffer unit, where side surface of material is equipped in mattress main body, KR 482052 Y1, Dec. 9, 2016 (Year: 2016).*

(Continued)

*Primary Examiner* — Megan Anderson
(74) *Attorney, Agent, or Firm* — Cramer Patent & Design PLLC; Aaron R. Cramer

(57) ABSTRACT

An exercise mat is fashioned as a tripartite mat assembly having a padded upper surface secured to a stiff lower surface. The mat has a handle disposed on a one (1) of the mat assembly sections and also includes a securing fastener capable of securing the exercise mat in a closed configuration.

1 Claim, 3 Drawing Sheets

(56) References Cited

U.S. PATENT DOCUMENTS 5,199,120 A * 4/1993 Holmes ..... A45F 4/06 5/419
5,203,041 A * 4/1993 Alonso ..... A47C 17/82 5/420
5,265,292 A * 11/1993 Underell ..... A47C 4/52 5/419
5,417,636 A * 5/1995 Havens ..... A63B 21/0552 482/145
5,491,851 A * 2/1996 Alonso ..... A47C 27/001 5/722
5,551,934 A * 9/1996 Binette ..... A63B 21/4037 482/130
5,720,057 A * 2/1998 Duncan ..... A61G 1/01 5/699
5,779,513 A * 7/1998 Burton ..... B63B 34/50 441/129
6,062,930 A * 5/2000 Smith ..... A47C 15/006 441/125
6,321,401 B1 * 11/2001 Fleming ..... A47C 27/001 5/722
6,322,485 B1 * 11/2001 Marrero ..... A63B 21/4037 482/142
D486,876 S * 2/2004 Wilbanks ..... D21/809
D487,551 S * 3/2004 Lee ..... D6/582
7,207,932 B1 * 4/2007 Dean ..... A63B 23/0211 482/148
7,520,846 B1 4/2009 Manuel
7,648,449 B1 * 1/2010 Detert ..... A63B 6/00 482/111
D619,722 S * 7/2010 Pierce ..... D24/183
D636,831 S * 4/2011 Mikula ..... D21/803
8,734,308 B1 5/2014 Joslin
D740,904 S * 10/2015 Santaw ..... D21/803
10,315,086 B1 * 6/2019 Johnson ..... A63B 69/0013
10,744,361 B2 * 8/2020 Duval ..... A63B 21/4037
11,401,730 B2 * 8/2022 Brensinger ..... A47B 3/06
2002/0056418 A1 * 5/2002 Fleming ..... A47C 31/007 119/28.5
2005/0017463 A1 * 1/2005 Kane ..... A63B 69/0093 280/14.22
2005/0081297 A1 * 4/2005 Woodward ..... A47D 5/006 5/655
2005/0233823 A1 * 10/2005 Klein ..... A63B 55/10 473/282
2006/0027471 A1 * 2/2006 Ji Ping ..... A45C 11/00 206/314
2006/0194679 A1 * 8/2006 Hatcher ..... A63B 21/0552 482/121
2007/0275827 A1 * 11/2007 Glaser ..... A63B 21/4037 482/148
2008/0096684 A1 * 4/2008 Lara ..... A63B 69/3661 473/278
2008/0118671 A1 * 5/2008 Bienkiewicz ..... A63B 21/4037 428/12
2008/0214361 A1 * 9/2008 Oster ..... A63B 21/4037 482/23
2009/0179446 A1 * 7/2009 Ahlers ..... A45F 4/06 294/137
2009/0297811 A1 * 12/2009 Hutchinson ..... A63B 21/4037 428/220
2010/0227124 A1 * 9/2010 Sharir ..... A47G 27/0212 428/317.1
2010/0267532 A1 * 10/2010 Newburger ..... A63B 23/0216 482/142
2010/0323862 A1 * 12/2010 Sohn ..... A63B 21/4037 482/145
2012/0053029 A1 * 3/2012 Newburger ..... A63B 21/4037 482/142
2012/0210512 A1 * 8/2012 Woods ..... A47G 27/0237 5/417
2012/0233772 A1 * 9/2012 Wang ..... A63B 21/4037 5/417
2014/0162853 A1 * 6/2014 Kadar ..... A63B 23/03541 482/130
2015/0173473 A1 * 6/2015 Jenkins ..... A45C 3/04 190/1
2015/0297941 A1 * 10/2015 Fleming ..... A63B 21/4037 5/417
2015/0321046 A1 * 11/2015 Lee ..... B32B 5/32 428/78
2015/0321047 A1 * 11/2015 Whiteley ..... A47G 27/0237 5/417
2016/0129299 A1 * 5/2016 Newman ..... A63B 21/4037 482/142
2017/0127852 A1 * 5/2017 Escajeda ..... A47D 5/006
2017/0172331 A1 * 6/2017 Publicover ..... B32B 7/022
2018/0093118 A1 * 4/2018 Laitta ..... A63B 71/0054
2018/0272180 A1 * 9/2018 Abrahams ..... A63B 21/4037
2018/0345113 A1 * 12/2018 May, II ..... B32B 25/047
2019/0010634 A1 * 1/2019 Aotani ..... B32B 3/263
2019/0269253 A1 * 9/2019 Hathorn ..... A47C 27/14
2019/0350318 A1 * 11/2019 Levine ..... A47K 10/02
2019/0351277 A1 * 11/2019 Bassoo ..... A63B 21/4035
2019/0358487 A1 * 11/2019 Mason ..... A63B 21/4037
2019/0383347 A1 * 12/2019 Van den Avont ..... B32B 5/18
2020/0282257 A1 * 9/2020 Essex ..... A63B 21/4037
2020/0353307 A1 * 11/2020 Zanyk ..... A63B 21/4037
2022/0008279 A1 * 1/2022 Conrad ..... A61G 15/002

OTHER PUBLICATIONS

KR200482052Y1 (Google translate_Abstract) (Year: 2016).*
STIC (Year: 2022).*
Tri-Fold Folding Exercise Mat 6X4X2. Product Listing [online]. @ 2019 PROSOURCEFIT [retreived on May 21, 2019]. Retrieved from the Internet: <URL: https://www.prosourcefit.com/products/tri-fold-folding-exercise-mat-6x4x2?variant=45878654670&gclid=Cj0KCQjww47nBRDIARIsAEJ34bnKF9wBARNjwpKLDfaq5B0m4Zr31RuhgU67s3XvWVn9CEGB5JB0rlgaAgAzEALw_wcB>.
Natural dance floor (16 handle colors). Product Listing [online]. @ 2019 FASFOOT [retreived on May 21, 2019]. Retrieved from the Internet: <URL: https://www.fasfoot.com/product/natural-floor/>.

* cited by examiner

FOLDING EXERCISE MAT

RELATED APPLICATIONS

Not applicable.

FIELD OF THE INVENTION

The present invention relates to a folding exercise mat.

BACKGROUND OF THE INVENTION

Physical fitness and health considerations are areas of highest concern among Americans today. More than ever, people are frequenting health clubs and performing exercise equipment routines at home in order to lose weight, improve muscle tone, and maintain a healthy lifestyle.

However, many people are also leading a more mobile lifestyle, which includes frequent travel, restaurant meals, and being away from home for weeks or even months at a time. Unless a person is staying at a hotel with an exercise room, there is very little a person can do to exercise other to walk or run.

Having recognized the abovementioned problems, the inventor observed there remains a need for a means by which exercise routines can be performed at almost any location without the need for large or heavy exercise equipment. The development of the folding exercise mat fulfills this need.

SUMMARY OF THE INVENTION

The inventor has recognized the aforementioned, inherent problems and lack in the art and observed that there is a need for an exercise mat comprises a plurality of identical separate portions which are hingedly attached to each other such that each of the separate portions fold and stack on top of each other to condense into a folded configuration. The separate portions having a center portion with a center mat section affixed or bonded to a center backing section, a first side portion having a first mat section affixed or bonded to a first backing section, and a second side portion having a second mat section affixed or bonded to a second backing section, a first side of the center portion is hingedly attached to a first side of the first side portion with a first hinged section and a second side of the center portion is hingedly attached to a first side of the second side portion with a second hinged section.

The hinged sections enable the first side portion and the second side portion to hinge fully overtop of the center portion so that each of the portions have a coextensive outer perimeter. The mat also comprises a strap having a first end fixedly attached to an end of the center backing section of the center portion with a first fastener. The first end is on either edge perpendicular to the hinged sections. The mat also comprises a second fastener which is located on a first backing section of the first portion. The second fastener receives the second end of the strap. The strap and the second fastener are located at positions that are aligned when the exercise mat is in the folded configuration. The mat also comprises a handle affixed to one of the backing sections of one of the portions.

The separate portions may include three separate portions. The separate portions may have a square cross-section so as to provide a balanced weight when the exercise mat is in transport when in the folded configuration. The mat sections may be cushioned or are slightly deformable. The mat sections may be made of resilient material providing support and comfort to an individual lying thereon or may be made of polyethylene foamboard. The mat sections may include a covering which may be leather or vinyl. The backing sections may be identical to each other and may be made of a durable and resilient material. The backing sections may be made of plywood that provides structural rigidity or a particle board that provides structural rigidity. The hinged sections may comprise a living hinge that does not rupture or fracture when bent during instantaneous, repeated, or subsequent usage.

The handle may be affixed to the first backing section of the first portion or to the second backing section of the second portion. The exercise mat may be one inch in thickness and may be one-and-a-half feet wide to accommodate human width. The exercise mat may be six-and-three-quarter feet in length to accommodate human height and six-and-three-quarter feet in length to cover a conventional bed length. The exercise mat may support 250 pounds.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
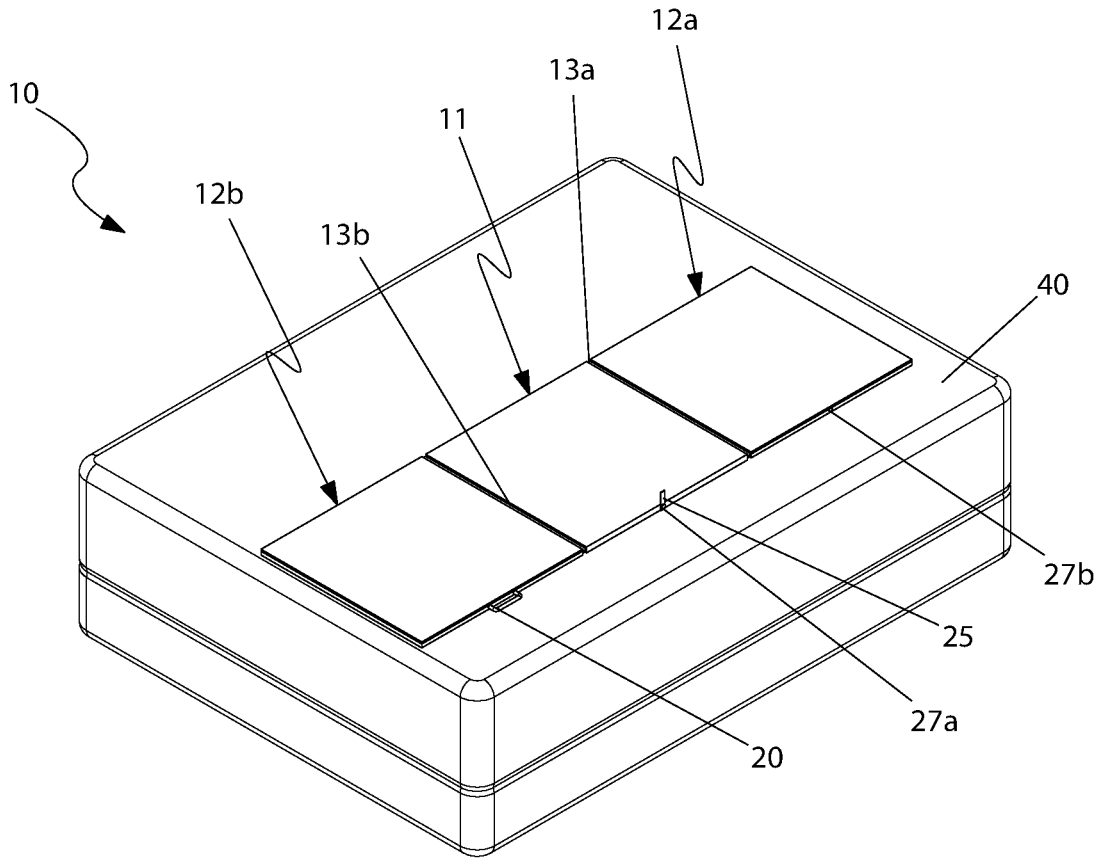
FIG. 1 is a front top perspective environmental view of an exercise mat 10 in an extended configuration, according to a preferred embodiment of the present invention.

10 exercise mat
11 center portion
12*a* first side portion
12*b* second side portion
13*a* first hinged section
13*b* second hinged section
13*c* first alternate hinged section
13*d* second alternate hinged section
20 handle
25 strap
27*a* first fastener
27*b* second fastener
30*a* first backing section
30*b* second backing section
31 center backing section
32 center mat section
35*a* first mat section
35*b* second mat section

40 bed
45 first alternate exercise mat
50 second alternate exercise mat

DESCRIPTION OF THE PREFERRED EMBODIMENTS

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Figure 2:
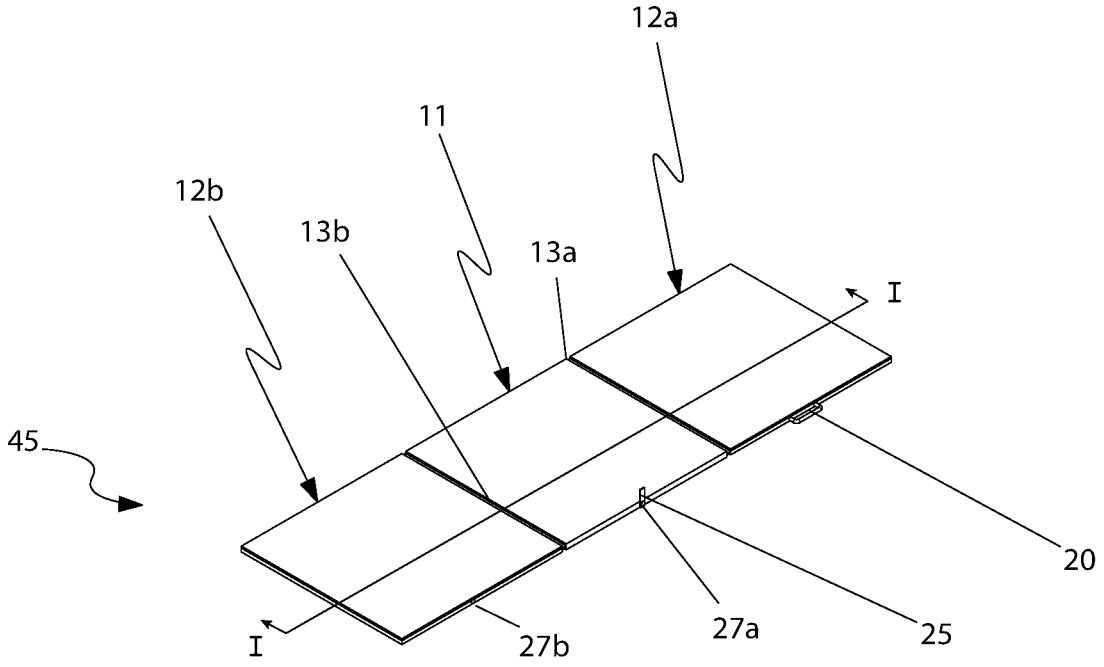
FIG. 2 is a front top perspective view of the exercise mat 40, according to a first alternate embodiment of the present invention.
Figure 3A:
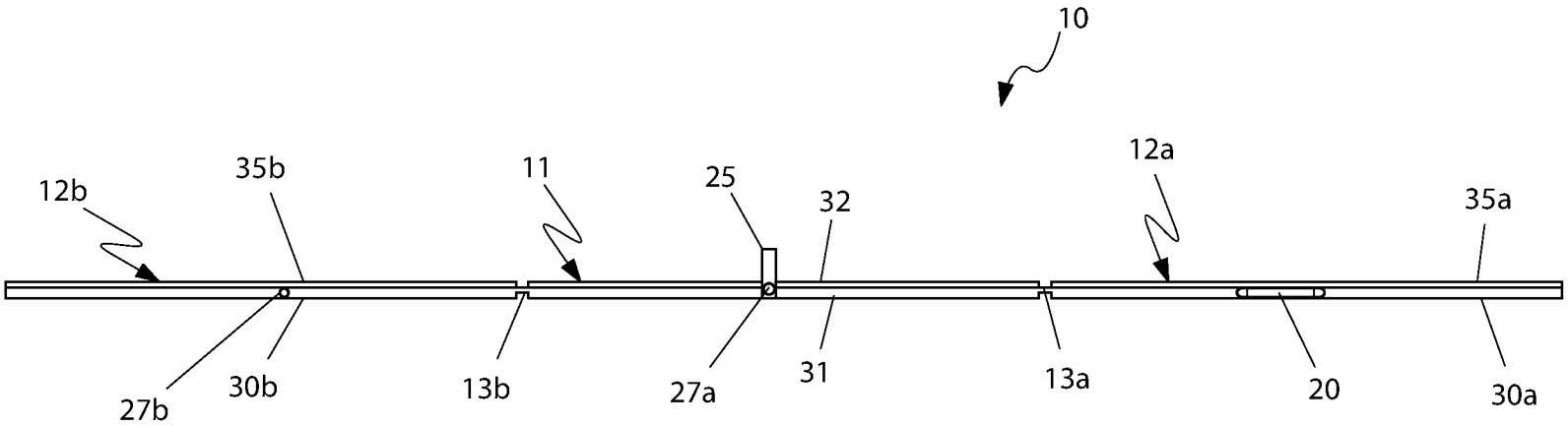
FIG. 3*a* is a first side view of the exercise mat 10, according to the preferred embodiment of the present invention.
Figure 3B:
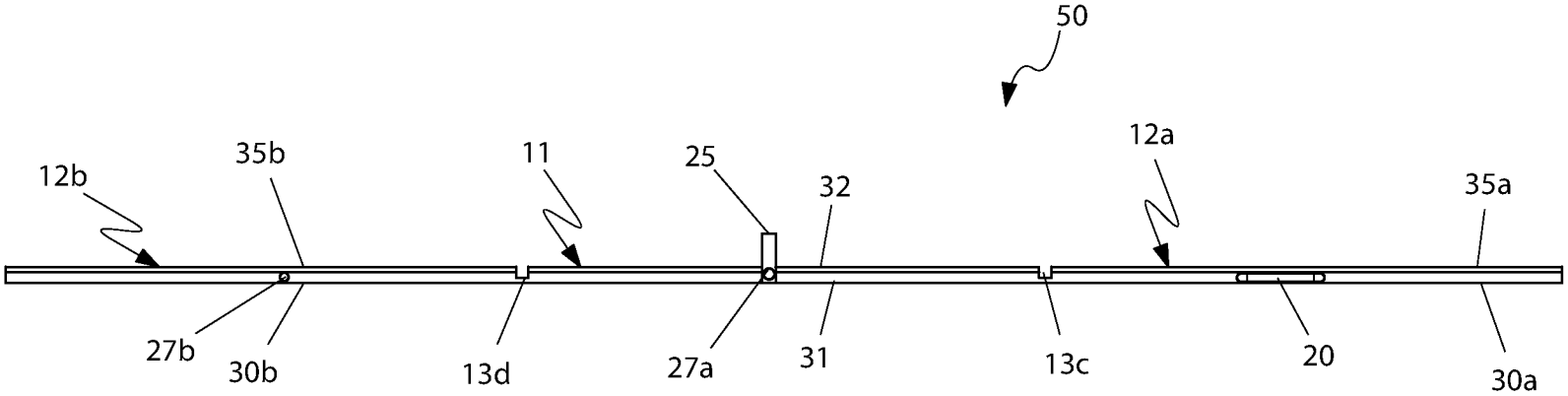
FIG. 3*b* is a first side view of the exercise mat 50, according to a second alternate embodiment of the present invention; and, FIG. 4 is a front perspective view of the exercise mat 10 in a folded configuration, according to the preferred embodiment of the present invention.
Figure 4:
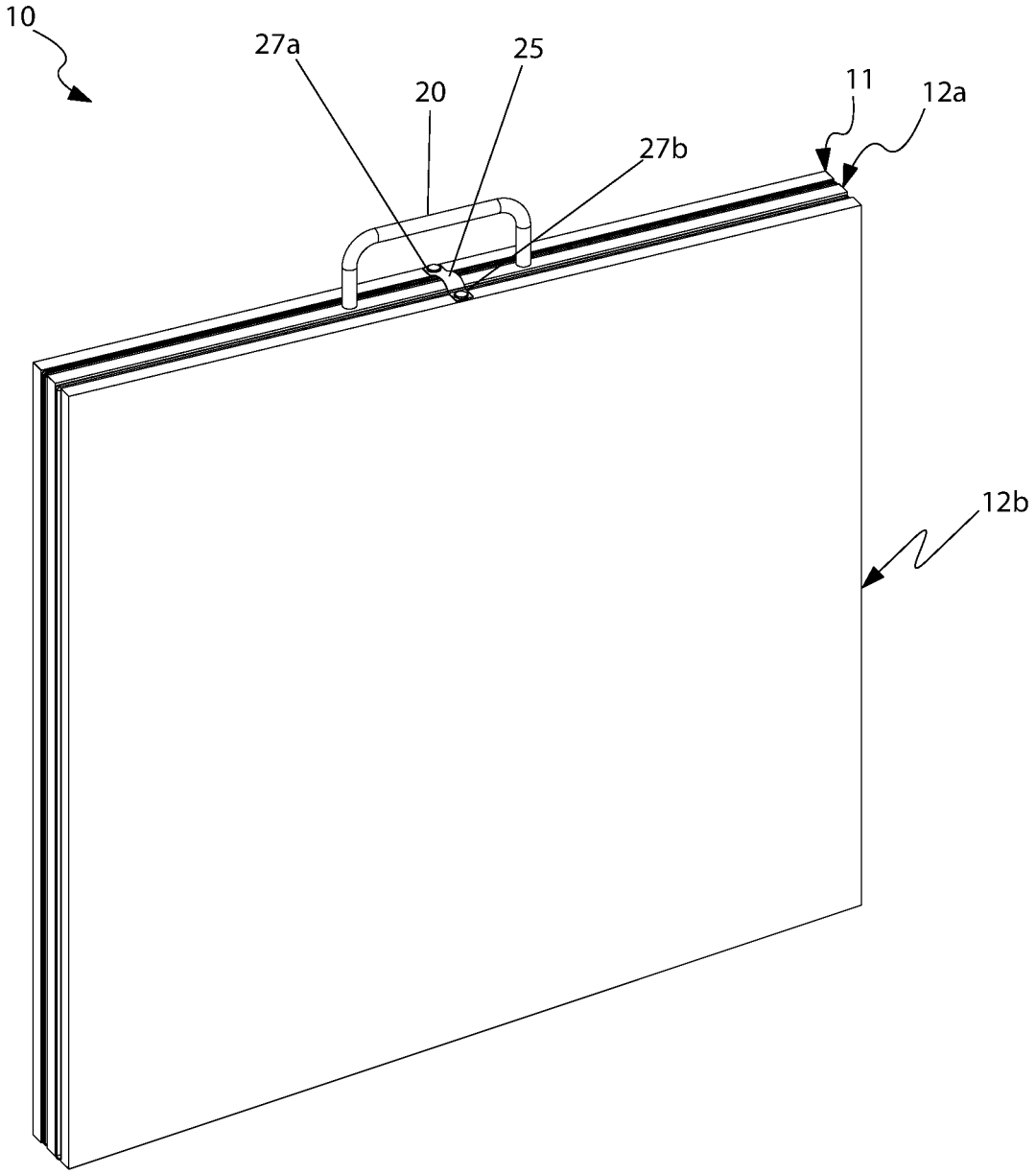

The invention herein described refers to an exercise mat 10 that is portable and capable of folding into a folded configuration (see FIG. 4) and expanded to an extended configuration (see any of FIGS. 1-3*b*). FIG. 1 illustrates a preferred embodiment of the exercise bed 10 in a fully extended configuration placed on a bed 40, although other surfaces are envisioned as falling under alternate methods of use. FIG. 3*a* illustrates the preferred embodiment of the exercise mat 10 showing the preferred hinged sections 13*a*, 13*b* and FIG. 4 illustrates the preferred embodiment of the exercise mat 10 in a folded configuration. FIG. 2 illustrates a first alternate exercise mat 45 showing alternate locations of handle 20 and strap 25 and FIG. 3*b* illustrates a second alternate exercise mat 50 showing alternate hinged sections 13*a, c*, 13*d*.

Upon full extension, the exercise mat 10 is configured in a relatively planar manner and a rectangular cross-section, with a minimal thickness (approximately one inch (1 in.) or less), a width slightly larger than a general width of a human (approximately one-and-a-half feet (1-½ in.), and a length at least capable of accommodating a human of average height and also capable of covering a majority of a length of a conventional bed 40 (approximately six-and-a-quarter feet (6-¾ ft.). When in the folded configuration, the overall shape of the exercise mat 10 is square or rectangular and comprises a weight capable of being carried. The exercise mat 10 also upon full extension preferably is capable of supporting a weight of a human weighing approximately two hundred fifty pounds (250 lbs.). It is appreciated that different embodiments can provide different dimensions, weights, and support capacities and fall under the overall general scope of the invention.

The exercise mat 10 generally comprises three (3) separate portions 11, 12*a*, 12*b* of nearly identical construction, although other numbers of sections is possible. The portions 11, 12*a*, 12*b* are hingedly attached to each other, such that they can "fold" or "stack" on top of each other to condense into a folded configuration that is the width and height of a single portion 11, 12*a*, or 12*b*. In a preferred embodiment, the portions 11, 12*a*, 12*b* have a square cross-section (i.e., the width and the height are equal in dimension) so as to provide a balanced weight when in transport when in the folded configuration (see FIG. 4)

Referring more closely to the preferred embodiment of the exercise mat 10, a center portion 11 includes a center mat section 32 affixed or otherwise bonded to a center backing section 31. A first side portion 12*a* has a first mat section 35*a* affixed or otherwise bonded to a first backing section 30*a*. A second side portion 12*b* has a second mat section 35*b* affixed or otherwise bonded to a second backing section 30*b*. The mat sections 32, 35*a*, 35*b* are each identical and preferably comprises a cushioning or slightly deformable, yet resilient material capable of providing support and comfort to an individual lying thereon, (e.g. polyethylene or polyurethane foamboard) that may or may not have a covering (e.g. leather, vinyl). The backing sections 30*a*, 30*b*, 31 are also identical to each other and is preferably a durable and resilient material (e.g., plywood or particle board) that provides structural rigidity to the respective portion 11, 12*a*, 12*b*.

A first side of the center portion 11 is hingedly attached to a first side of the first side portion 12*a* with a first hinged section 13*a* and a second side of the center portion is hingedly attached to a first side of the second side portion 12*b* with a second hinged section 13*b*. These hinged sections 13*a*, 13*b* enable the first side portion 12*a*, and second side portion 12*b* to hinge fully overtop of the center portion 11 so that each portion 11, 12*a*, 12*b* have a coextensive outer perimeter. Such hinged sections 13*a*, 13*b* can be a living hinge (i.e., a thinned section of the backing sections 30*a*, 30*b*, 31 that does not rupture or fracture when bent during instantaneous, repeated, or subsequent usage) that is illustrated in the preferred embodiment of the exercise mat 10. FIG. 3*a* illustrates the preferred embodiment of the exercise mat 10 that illustrates hinged sections 13*a*, 13*b* where the thinned portion of the backing sections 30*a*, 31 is adjacent to the respective mat sections 32, 35*a*, 35*b*. FIG. 3*b* illustrates a second embodiment of the exercise mat 50 that illustrates hinged sections 13*c*, 13*d* where the thinned portion of the backing sections 30*a*, 30*b*, 31 is opposite to the respective mat sections 32, 35*a*, 35*b*.

In a preferred embodiment of the exercise mat 10, there is a strap 25 that has a first end fixedly attached to an end of the center backing section 31 of the center portion 11 with a first fastener 27*a*. This end is on either edge perpendicular to the hinged sections 13*a*, 13*b*. In the same embodiment of the preferred exercise mat 10, a second fastener 27*b* is located on second backing section 30*b* of the second portion 12*b*. The second fastener 27*b* is capable of securely receiving the second end of the strap 25. The strap 35 and second fastener 27*b* are located at positions that are aligned when the exercise mat 10 is in the folded configuration. Affixed to the second backing section 30*b* of the second portion 12*b* is a handle 20. In this preferred method of folding the exercise mat 10, the second portion 12*b* folds over the center portion 11 and the first portion 12*a* folds over the second portion 12*b*. This positioning enables the exercise mat 10, when folded, to have the handle 20 in the middle and the strap 25 securing the center portion 11 to the first portion 12*a* while encompassing the second portion 12*b*.

In the first alternate exercise mat 45, as seen in FIG. 2, the strap 25 is similarly fixedly attached to the center portion 11 with a first fastener 27*a*. In the same embodiment of the first alternate exercise mat 45, the second fastener 27*b* is located on second backing section 30*b* of the second portion 12*b*.

The second fastener 27*b* is capable of securely receiving the second end of the strap 25. The strap 35 and second fastener 27*b* are located at positions that are aligned when the first alternate exercise mat 45 is in the folded configuration. Affixed to the first backing section 30*a* of the first portion 12*a* is a handle 20. In this preferred method of folding the first alternate exercise mat 45, the first portion 12*a* folds over the center portion 11 and the second portion 12*b* folds over the first portion 12*a*. This positioning enables the first alternate exercise mat 45, when folded, to have the handle 20 in the middle and the strap 25 securing the center portion 11 to the second portion 12*b* while encompassing the first portion 12*a*. Referring to the second alternate exercise mat 50, either orientation and location of the handle 20 and strap 25 is understood to fall under the scope of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An exercise mat, consisting of:

a plurality of identical separate portions hingedly attached to each other such that each of the identical separate portions fold and stack on top of each other to condense into a folded configuration, the identical separate portions having a center portion with a center mat section affixed or bonded to a center backing section, a first side portion having a first mat section affixed or bonded to a first backing section, and a second side portion having a second mat section affixed or bonded to a second backing section, a first side of the center portion is hingedly attached to a first side of the first side portion with a first hinged section and a second side of the center portion is hingedly attached to a first side of the second side portion with a second hinged section, the first and second hinged sections enable the first side portion and the second side portion to hinge fully overtop of the center portion so that each of the identical separate portions have a coextensive outer perimeter;

a strap having a first end fixedly attached to an end of the center backing section of the center portion with a first fastener, the first end of the strap is on a top edge of the center backing section perpendicular to the first and second hinged sections;

a second fastener located on the first backing section of the first side portion, the strap and the second fastener are located at positions that are aligned when the exercise mat is in the folded configuration; and a handle affixed to a middle portion of the second backing section of the second side portion;

wherein the strap secures the center portion to the first side portion while encompassing the second side portion when the identical separate portions are folded;

wherein the first and second hinged sections are each a coextensive living hinge that does not rupture or fracture when bent during instantaneous, repeated, or subsequent usage;

wherein the center, first, and second mat sections are made of resilient material and are adapted to support and comfort to an individual lying thereon;

wherein the center, first, and second mat sections are made of polyethylene foamboard;

wherein the center, first, and second mat sections are cushioned;

wherein the identical separate portions have a square cross-section so as to provide a balanced weight when the exercise mat is in transport when in the folded configuration; and wherein the center, first, and second mat sections include a covering.

* * * * *